United States Patent [19]

Grieser, Sr. et al.

[11] 4,100,637

[45] Jul. 18, 1978

[54] COMBINATION TOOL

[76] Inventors: Fred J. Grieser, Sr., 1417 Barton Rd., Lake Worth, Fla. 33460; Fred J. Grieser, Jr., 101 Neptune Dr., Hypoluxo, Fla. 33462

[21] Appl. No.: 669,765

[22] Filed: Mar. 24, 1976

Related U.S. Application Data

[63] Continuation-in-part of Ser. No. 604,112, Aug. 13, 1975, abandoned.

[51] Int. Cl.[2] ..... B25F 1/00

[52] U.S. Cl. ..... 7/158; 7/165; 7/167

[58] Field of Search ..... 7/1 R, 15; 81/90 A; 279/1 K

[56] References Cited

U.S. PATENT DOCUMENTS

| | | | |
|---|---|---|---|
| 2,519,559 | 8/1950 | Foster et al. | 81/177 N |
| 2,824,651 | 2/1958 | Davis | 279/1 K |
| 2,880,008 | 3/1959 | Stoner | 279/1 K |
| 2,941,426 | 6/1960 | Muller et al. | 81/90 A |
| 3,049,946 | 8/1962 | Schelke | 279/1 K |
| 3,169,805 | 2/1965 | Dieterich | 81/90 A |
| 3,869,943 | 3/1975 | Buck | 279/1 K |

FOREIGN PATENT DOCUMENTS

| | | | |
|---|---|---|---|
| 1,099,478 | 2/1961 | Fed. Rep. of Germany | 81/90 A |

*Primary Examiner*—James L. Jones, Jr.
*Assistant Examiner*—Roscoe V. Parker
*Attorney, Agent, or Firm*—Frank P. Cyr

[57] ABSTRACT

A combination tool comprising a chuck key provided with at least one opening formed in the shaft thereof to receive therein a tool usually employed prior to the formation or following the formation of a hole in a structure. The chuck key is adapted to engage with the external teeth formed on one end of a chuck to either tighten or loosen the chuck on a tool such as a drill bit or the like. The tool carried by the shaft of the chuck key may comprise a punch, or a reamer, or a screw driver or the like.

7 Claims, 9 Drawing Figures

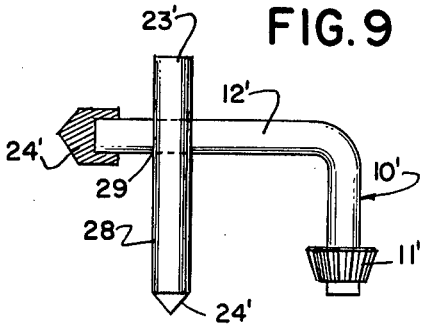
FIG. 9
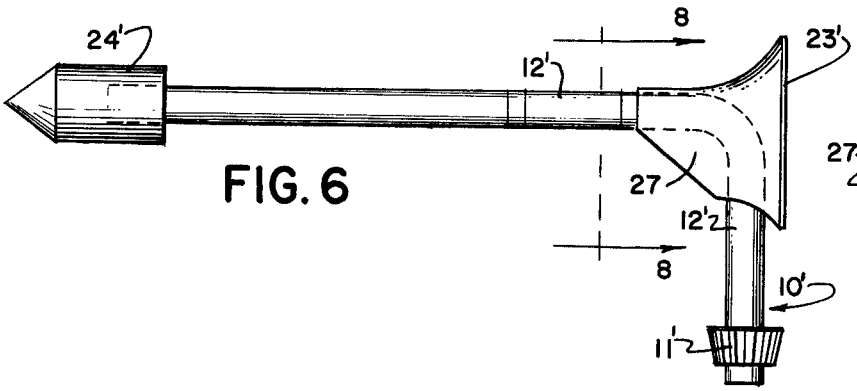
FIG. 6
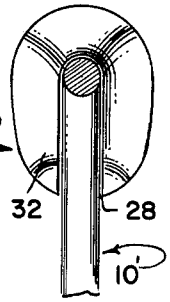
FIG. 8
FIG. 5
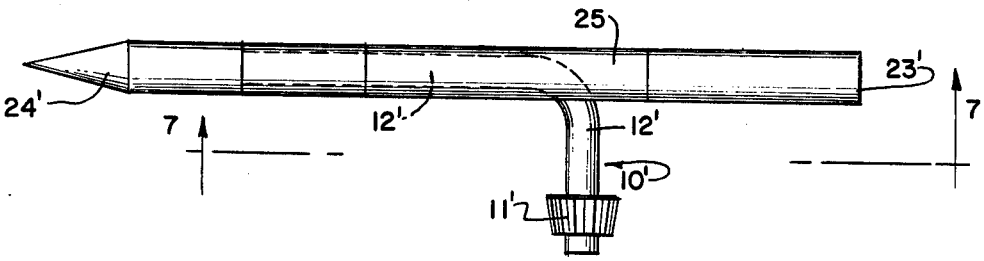
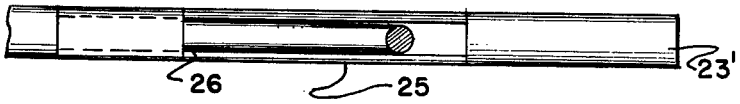
FIG. 7

COMBINATION TOOL

This is a continuation-in-part application of Ser. No. 604,112, filed Aug. 13, 1975 and now abandoned.

BACKGROUND OF THE INVENTION

A chuck key is usually furnished with the purchase of a conventional electric drill, the key being employed either to tighten or to loosen the drill bit in the chuck. As can be appreciated, in the formation of an opening in a surface it is usually necessary that a marker point be placed on the surface to be drilled so as to guide the operator of the drill to the proper location on the surface. This is usually formed by striking the surface with a punch and following the drilling operation it is usually necessary to smooth out the bore hole and this is usually accomplished by using a reamer and oftentimes following the drilling and reaming operation it then becomes necessary to employ a screw driver to secure an article to the bored opening.

Thus, with the above in mind, it is the primary object of the invention to provide a chuck key with at least one opening formed in the shaft thereof whereupon a tool usually employed in a drilling operation is secured to the chuck key to thus make readily available this tool to the operator of the drill.

Another object of the invention is to provide a tapered end on the shaft of a chuck key so as to enable the chuck key to be employed to form a marker point on a surface to be drilled.

Another object of the invention is to enable the operator of a drill provided with a chuck constructed in accordance with the present invention to employ any one of a number of tool associated therewith to use the same as a lever in tightening or loosening the drill bit holding chuck.

Another object of the invention is to provide a striking surface on one end of the shaft of the chuck so as to receive a blow imparted thereto as by a hammer blow when it is desired to form a point marker on a surface to be drilled.

These and other objects will become apparent from referece to the following description, attached drawings and appended claims.

DESCRIPTION OF THE DRAWINGS

FIG. 5 is a perspective view showing a modification of the invention.

FIG. 6 is a perspective view showing a further modification of the invention.

FIG. 7 is a section taken on lines 7—7 of FIG. 5, looking in the direction of the arrows.

FIG. 8 is a section taken on lines 8—8 of FIG. 6, looking in the direction of the arrows.

FIG. 9 is a perspective view showing a further modification of the invention.

DESCRIPTION OF THE PREFERRED EMBODIMENTS

Figure 1:
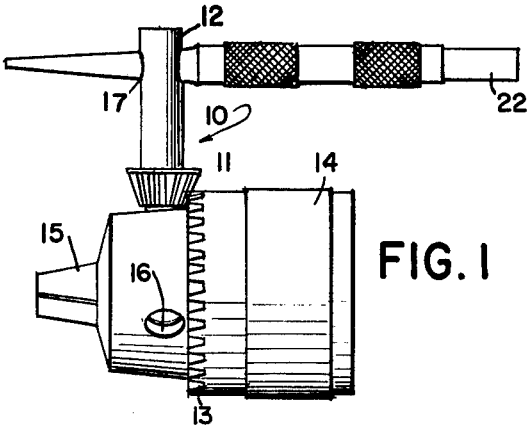
FIG. 1 is a perspective view showing the chuck and key with parts broken away as applied to a drill holding chuck.

Referring now to the drawings wherein like reference numerals are employed to designate like parts throughout the several views, numeral 10 designates generally a chuck key having a bevel gear 11 and a shaft 12 extending therefrom. The bevel gear 11 is adapted to engage a like bevel gear 13 formed at the forward end of a conventional chuck 14 having the usual drill bit engaging jaws 15 extending forwardly of said chuck 14. Openings 16 are formed along the sides of the chuck to receive the forward end of the key when the same is used to tighten or loosen the chuck jaws on the drill bit system.

Figure 4:
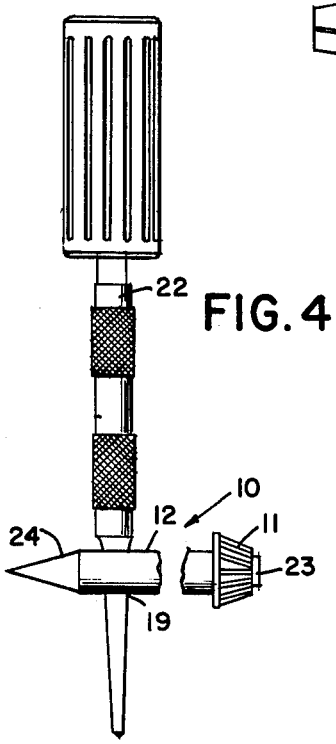
Figure 2:
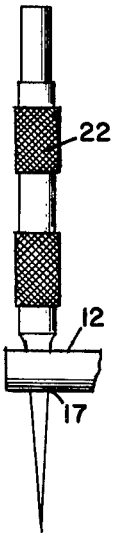
FIG. 2 is an elevational view, with parts broken away showing the manner in which the tool extends through the shaft of a chuck key.
Figure 3:
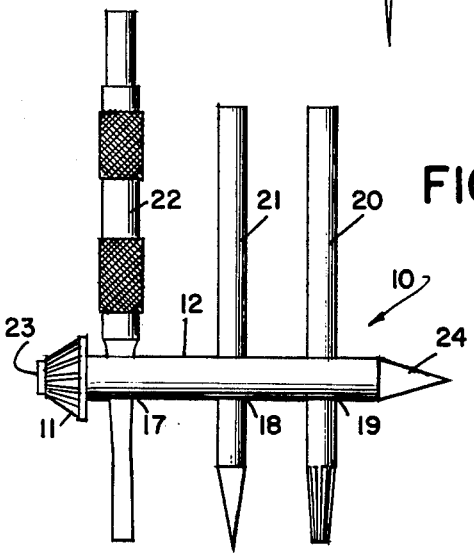
FIG. 3 is a front elevation view showing a plurality of tools mounted on the shaft of a chuck key, and, FIG. 4 is a side elevation view with parts broken away showing a screw driver mounted in one of the openings formed in the shaft of the chuck key.

Refering to FIGS. 1 to 4 inclusive of the drawings, a plurality of openings 17, 18 and 19 are formed along the shaft 12 and tools commonly employed in a drilling operation are mounted in these openings. For instance, a reamer 20, a punch 21 and a screw driver 22 can be placed in the aforesaid openings and retained therein until such time as use is made of the tool either before or after the drilling operation. A blow receiving area 23 is provided at one end of the chuck key and the opposite end thereof may be provided with a tapered area terminating in a sharp point 24. As can be appreciated, the key shown in FIG. 3 of the drawings can be employed to form a marker point by utilizing the key without employment of any of the tools adapted to be mounted on the shaft.

As stated previously any one of the tools 20, 21 or 22 may be employed to apply a leverage force on the bevel gear 13 on the chuck 14 to tighten or loosen the chuck jaws on the drill bit.

Referring now more particularily to FIGS. 5 to 9 of the drawings, there is shown therein a chuck key designated by reference numeral 10'. The key is provided at one end thereof with a bevel gear 11' which is designed to engage with a like bevel gear formed on the forward end of a conventional chuck and the same is designed to tighten or loosen the chuck jaws.

Shown in FIGS. 5 and 7 of the drawings is a chuck key 10' having a shaft 12' which is generally L-shaped. A sleeve 25 is provided with a slot 26 extending throughout substantially the length of the sleeve and is adapted to encircle the shaft 12. The sleeve 25 is constructed of a material which is substantially rigid but having sufficient resiliency to permit the shaft 12 to be forced into the aforesaid slot and once placed therein, the walls of the sleeve will revert to their original shape and retain the shaft within the sleeve. One end of the sleeve is provided with blow receiving area 23' whereas the opposite end thereof is provided with a removable punch-like member 24'.

Referring now to FIGS. 6 and 8, there is shown therein a slotted sheath 27 which is adapted to be fitted over the L-shaped shaft 12' of the key 10'. The sheath 27 is constructed of any suitable material and formed at one end of the sheath is an enlarged blow receiving area 23'. To apply the sheath over the shaft 12', one need only to force fit the shaft 12' into the slot 28 provided in the sheath and once the shaft has been so placed within the slot, the resiliency of the material of the sheath will frictionally retain the sheath on the shaft. The shaft has formed on one end thereof the bevel gear 11' and mounted on the opposite end is a removable tool 24' such as a punch, reamer, or the like.

Referring now to FIG. 9 of the drawings, there is shown therein a generally L-shaped chuck key 10' having a bevel gear 11' at one end thereof whereas a removable tool such as a punch, reamer, or the like, 24', is mounted on the other end thereof. A punch-like member 28 is provided with an opening 29 extending therethrough and one leg of the shaft 12' extends into said opening and is frictionally retained therein. A blow receiving area 23' is provided at one end of the punch 28.

It should be pointed out that in all instances where we have described the employment of a punch at one end of the shaft of the chuck key, the same may be substituted and a reamer, screw driving head, allen-type wrench, or the like may be used in lieu of the punch. Also, all of the aforegoing attachments are applied to the end of the shaft and the internal bore of each of these attachments is slightly tapered so that when the attachment is forced on to the end of the shaft, the same will be frictionally retained thereon although capable of being removed therefrom and replaced with another tool.

Thus, it will be seen that I have provided a convenient means whereby the tools usually employed in conjunction with a drilling operation are readily made available to the user of the drill thus obviating the necessity of having to locate such tools which are usually retained in some type of tool box.

It is to be understood that while there has been described herein in detail and illustrated in the accompanying drawing a presently preferred embodiment of this invention, various modifications, omissions and refinements which depart from the illustrated embodiment may be adopted without departing from the spirit and scope of the invention.

We claim:

1. A combination tool comprising a chuck key having a fixed bevel gear and a shaft extending from said bevel gear, said gear engaging a like bevel on a drill holding chuck for actuating said chuck, a plurality of openings formed in said shaft and a plurality of tools mounted on said shaft, a blow receiving area at one end of said shaft and a tapered pointed end at the opposite end thereof for forming a marker point on a surface by imposing a blow on said blow receiving area.

2. The structure recited in claim 1 wherein one of said tools comprises a screw driver.

3. The structure recited in claim 1 wherein one of said tools comprises a punch.

4. The structure recited in claim wherein one of said tools comprises a reamer.

5. The structure recited in claim 1 wherein a slotted sleeve partially encircles said shaft and wherein said blow receiving area is formed on said sleeve.

6. The structure recited in claim 5 wherein said sleeve is frictionally retained on said shaft.

7. A combination tool comprising a chuck key having a fixed bevel gear and a shaft extending from said bevel gear, said gear engaging a like bevel on a drill holding chuck for actuating said chuck, a tool mounted on said shaft, a blow receiving area at one end of said tool and said shaft and a tapered pointed end at the opposite end of said tool and shaft for forming a marker point on a surface by imposing a blow on one of said blow receiving areas.

* * * * *